United States Patent [19]

Socha

[11] Patent Number: 4,990,085

[45] Date of Patent: Feb. 5, 1991

[54] ARRANGEMENT FOR AN EXHAUST IN A PLANT ARRANGED FOR THE HEAT-TREATMENT OF PRODUCTS IN FORM OF A CONTINUOUS STRIP

[75] Inventor: Jürgen Socha, Vänersborg, Sweden

[73] Assignee: Impact Systems Inc., San Jose, Calif.

[21] Appl. No.: 399,528

[22] PCT Filed: Feb. 24, 1988

[86] PCT No.: PCT/SE88/00078

§ 371 Date: Aug. 22, 1989

§ 102(e) Date: Aug. 22, 1989

[87] PCT Pub. No.: WO88/06657

PCT Pub. Date: Sep. 7, 1988

[30] Foreign Application Priority Data

Feb. 24, 1987 [SE] Sweden ..... 8700765

[51] Int. Cl.[5] ..... F27B 9/28; F26B 13/00

[52] U.S. Cl. ..... 432/59; 34/155; 34/156

[58] Field of Search ..... 432/59, 207; 34/155, 34/23, 79, 86, 92, 156

[56] References Cited

U.S. PATENT DOCUMENTS 4,475,294 10/1984 Hendricks ..... 34/79

4,589,843 5/1986 Smith ..... 432/59

*Primary Examiner*—Henry A. Bennet

*Attorney, Agent, or Firm*—Dvorak and Traub

[57] ABSTRACT

Exhaust apparatus for a continuous metal strip heat treating plant having means for influencing the continuous strip with air or heat-treatment medium, which is supplied to the continuous strip so as to flow essentially parallel along the strip, and an opening which permits the heat-treatment medium to pass outward from one surface of the continuous strip.

17 Claims, 5 Drawing Sheets

27
28
21
Po
22

30
21
19
12
16
8
4
25
X
23
1A
3
Pö
5A
1B
1

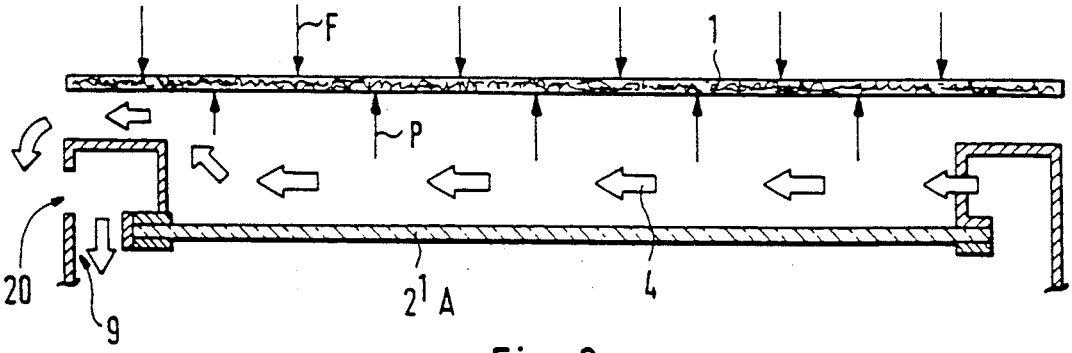
Fig. 8
Fig. 9
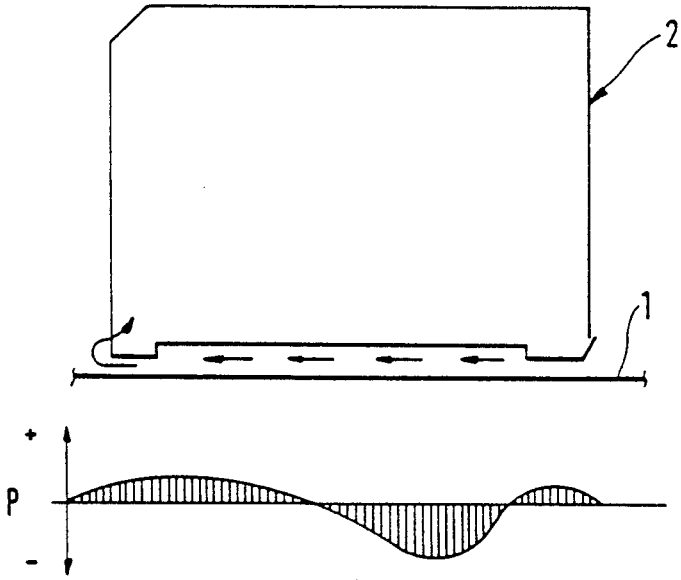
Fig. 10

ARRANGEMENT FOR AN EXHAUST IN A PLANT ARRANGED FOR THE HEAT-TREATMENT OF PRODUCTS IN FORM OF A CONTINUOUS STRIP

The present invention relates to an arrangement for an exhaust in a plant arranged for the heat-treatment of products in the form of a continuous strip, which includes means for influencing the continuous strip in question with air or some other heat-treatment medium, which is supplied to the continuous strip in such a way as to flow essentially parallel along same in a common direction, and an opening, which permits the air, etc., with which the continuous strip is treated, to pass outwards from one surface of the continuous strip in question.

In conjunction with the drying or other heat-treatment of products in the form of a continuous strip, such as paper and plastic webs, use is frequently made of heat-treatment plants, such as driers, in which air or some other heat-treatment medium is intended to transfer heat, absorb gases or water vapour released from the continuous strip by evaporation, and stabilize the continuous strip on its way through the plant. The air is sometimes also used to transport or carry the continuous strip through the plant. Heat-treatment plants other than those which operate with a supply of air can be found, for example those which operate on the basis of IR radiation or direct heat.

The design of the outlet openings of the plant and the exhaust air openings influence the above-mentioned factors, especially in connection with the processing of thin products, such as paper. The design of such openings is also critical when broad and/or fast-moving continuous strips are used, since this has an effect on the result of heat-treatment, the performance and the ease of operation of the plant.

A previously disclosed drier plant is illustrated in the drawings in FIGS. 2 and 3, and the problems associated with this plant include the following:

1. The quantity of supply air and exhaust air must be precisely balanced in order to prevent heat from leaking out into the surroundings and reducing the quality of the environment around the drier.

2. The quantity of supply air and exhaust air must be precisely balanced in order that the distance between the drier and the continuous strip shall be neither too short (thereby reducing efficiency) nor too long (thereby giving rise to the risk of scoring of the continuous strip). This is in spite of the fact that the stretching and tensioning of the continuous strip often varies for different reasons.

3. Any variation in the distance will result in a variation in drying, which will affect the drying process adversely, resulting in varying moisture profiles.

Certain solutions are associated with a considerable risk, if the quantity of exhaust air is too great, of the continuous strip simply being sucked fast against the exhaust air gap. The quantity of exhaust air must be reduced in such cases, leading to a change in drying, in the distance of the continuous strip, and in the amount of air which leaks into the premises.

4. The driers are often large (1–20 m in length, and 1–10 m in width), since the drying times for the majority of drying processes require this. The immediate problem which arises is one of maintaining the pressure distribution inside the drier completely even across the continuous strip. Uneven pressure distribution leads to uneven pressure on the continuous strip, and thus to differences in heat transfer and the risk of creasing, fluttering or similar problems which can cause serious operational breakdowns.

The previously disclosed arrangement used in the plant referred to in SE patent application (as published for opposition) No. 7513864-4 (Publication No. 397 547) includes blower boxes, from which air is intended to be blown out onto a continuous strip of product in such a way as to lift the strip for the purpose of transporting same. Arranged between said blower boxes are openings which are in communication with a surrounding space, or separately with a space in which ambient pressure is present. What is not present in this case, however, is an exhaust channel which operates by negative pressure in said previously disclosed plant, in which case the corresponding problems which are encountered in conjunction with the balancing of the supply air and the exhaust air do not arise in this previously disclosed arrangement. Every blower box is supplied by means of fans with air under positive pressure, which is caused to flow out in a direction in which it is inclined towards the continuous strip of material, and at high speed, so that it flows in a parallel sense between the continuous strip of material and the blower box only once it has arrived, with the result that the resulting force acts perpendicular to the continuous strip, which leads to problems. Air which is to be led away from the continuous strip is sucked out via an opening in the previously disclosed arrangement, for recirculation on the one hand to the continuous strip and on the other hand into the surrounding environment, as indicated by the arrows. The fact that suction takes place via the openings results in those problems being encountered, which the present invention seeks to resolve, that is to say the function of the arrangement is the direct opposite of what is the case with the present invention. The exhaust in the previously disclosed plant is in communication with the surrounding environment via a channel which serves as a separator for the return air, which is led away from the continuous strip.

The principal object of the present invention is thus, in the first place, to make available an exhaust arrangement which solves said problems.

Said object is achieved by means of an arrangement in accordance with the present invention, which is characterized essentially in that an exhaust opening situated on the inlet side and/or outlet side of the heat-treatment plant for the product in the form of a continuous strip, and between said inlet side and outlet side, is connected to an exhaust channel, in which negative pressure is present, and to an inlet, at which ambient pressure is so arranged as to be effective, via which the pressure system inside the heat-treatment plant can be punctuated by air, etc., introduced from the surrounding environment, or from a chamber inside which essentially atmospheric pressure is present.

The invention is described below as a preferred illustrative embodiment, in conjunction with which reference is made to the accompanying drawings, in which:

FIG. 8 shows in schematic form the effect of the air in a plant;

FIG. 9 shows a plant in schematic form, and in cross section; and

FIG. 10 shows the pressure distribution in a plant in accordance with FIG. 9.

Figure 1:
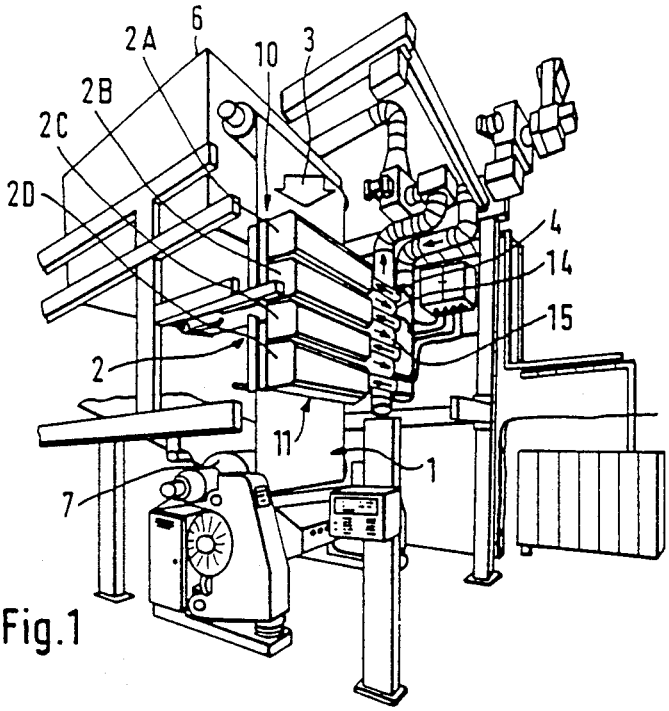
FIG. 1 shows a heat-treatment plant in perspective view.
Figure 2:
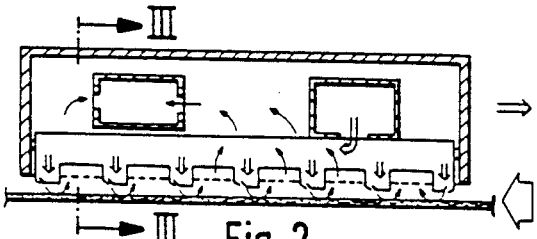
FIG. 2 shows a previously disclosed drier plant in cross-section.
Figure 3:
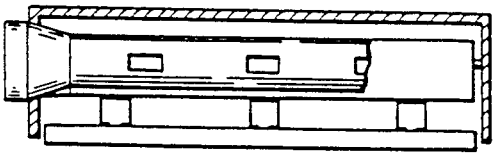
FIG. 3 shows a section along the line III—III in FIG. 2.
Figure 4:
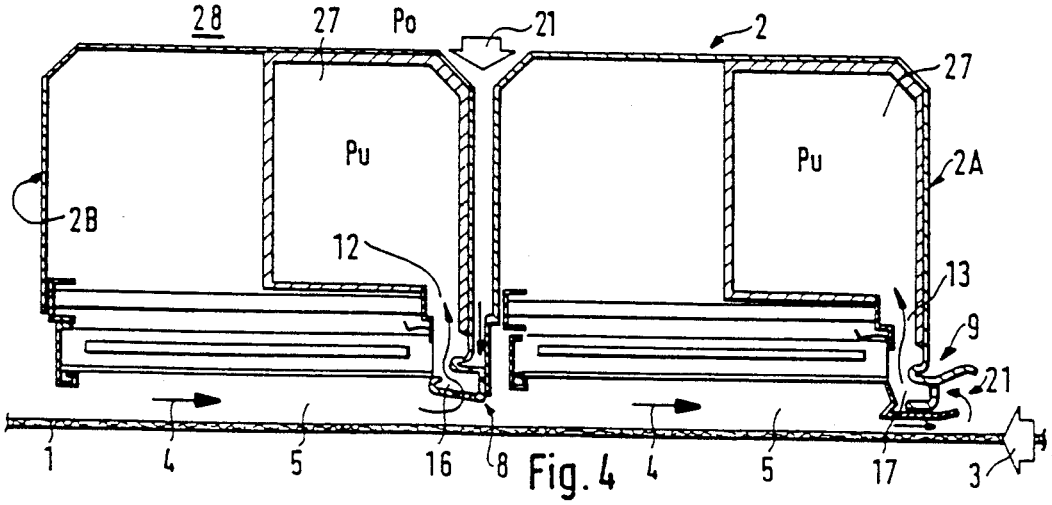
FIG. 4 shows a section through a heat-treatment plant arranged with the exhaust arrangement in accordance with the present invention.
Figure 5:
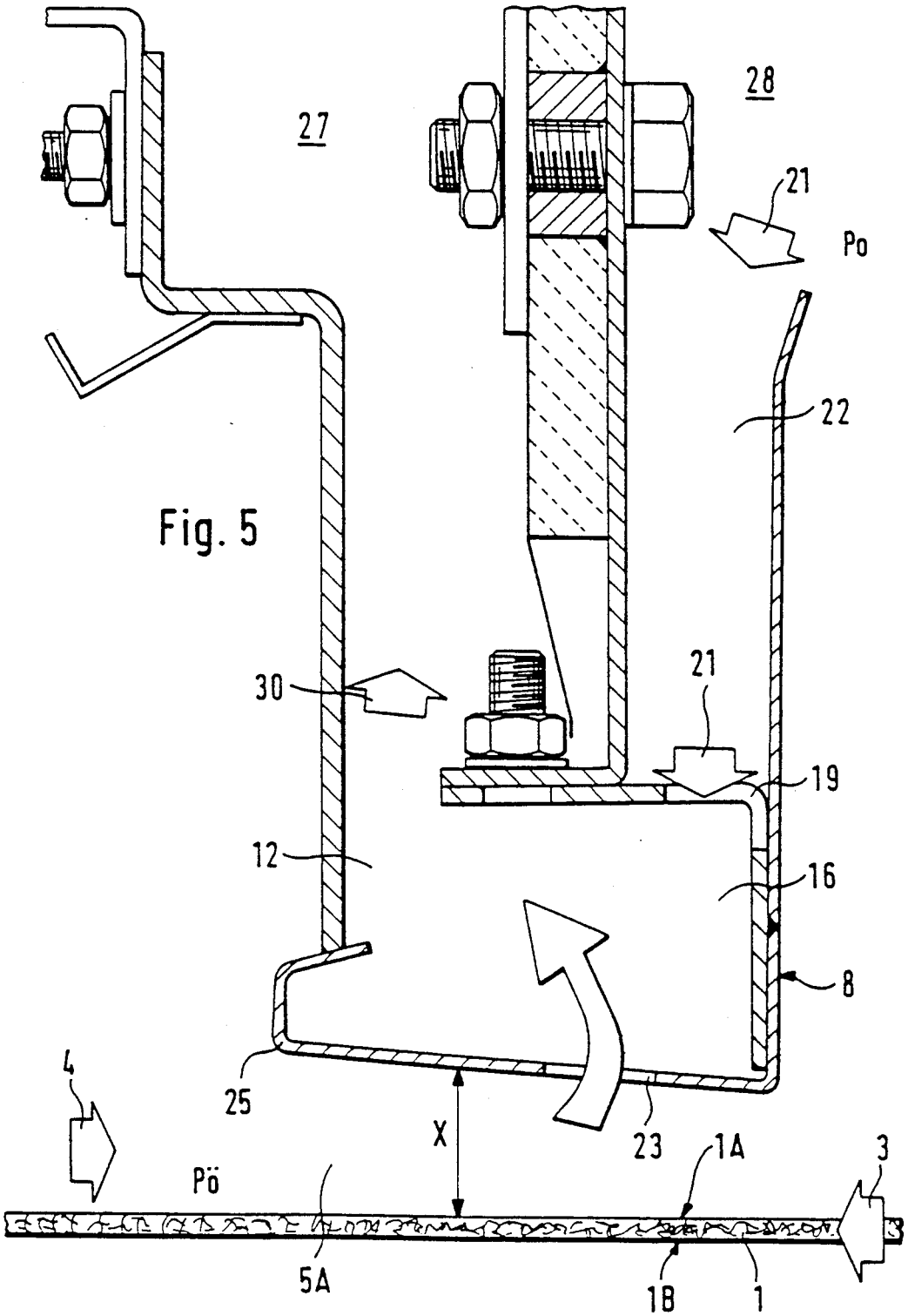
FIG. 5 shows a section through a first illustrative embodiment of an exhaust arrangement arranged in accordance with the invention.
Figure 6:
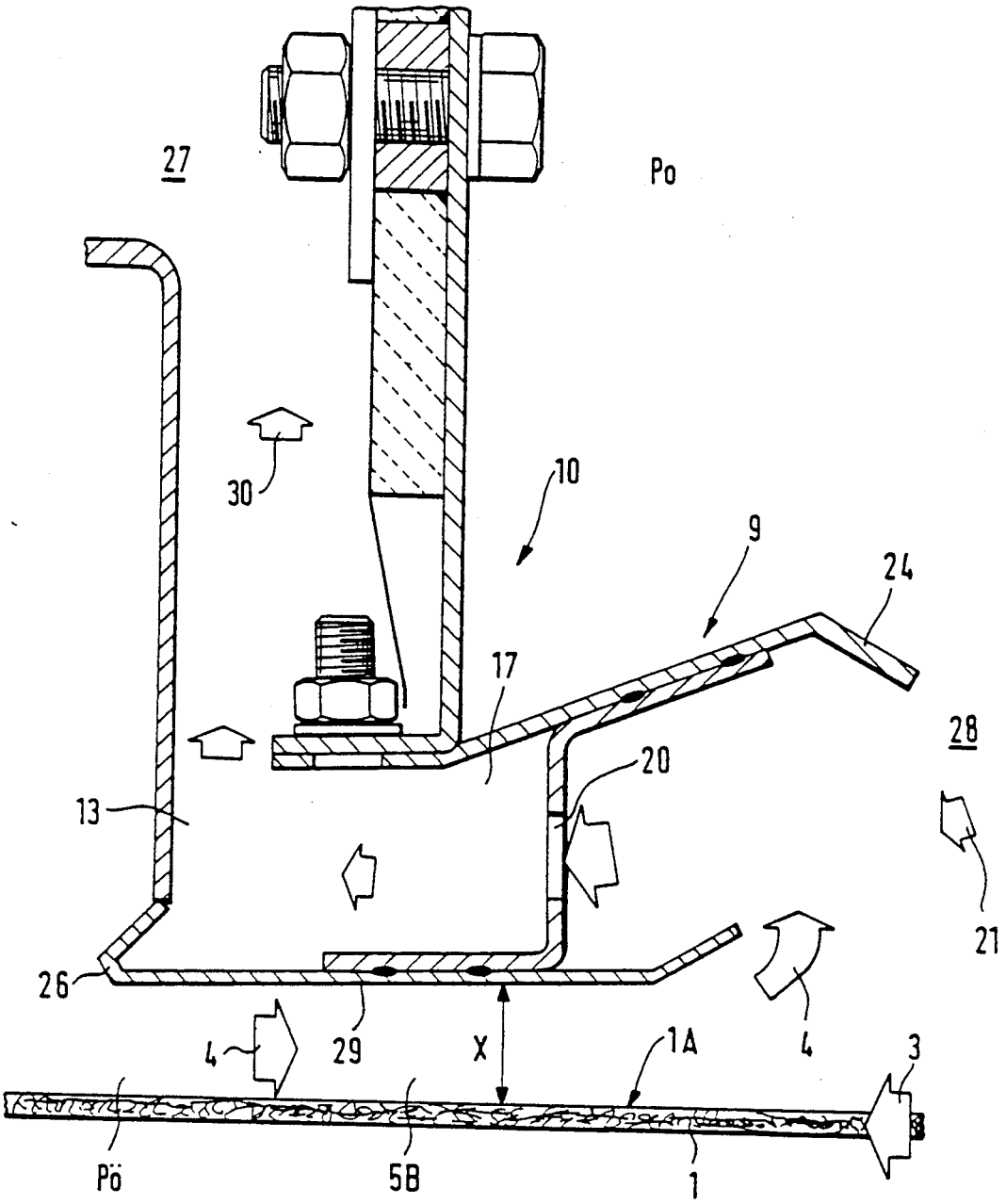
FIG. 6 shows a section through a second illustrative embodiment of an exhaust arrangement.
Figure 7:
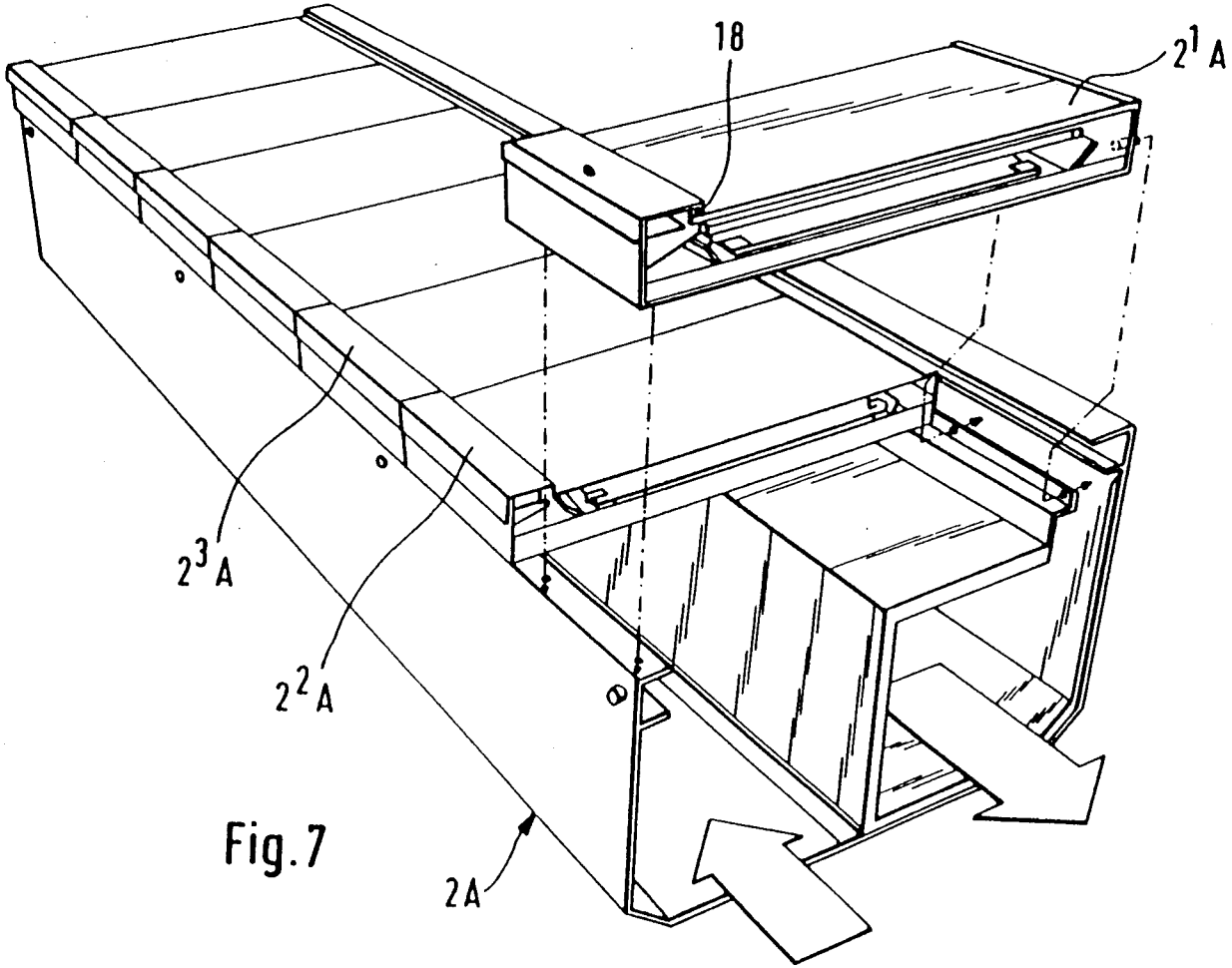
FIG. 7 shows the construction of a ramp which is a part of the plant.

Arranged next to a paper web 1, or a product of some other kind in the form of a continuous strip, is a heat-treatment plant 2, which is intended to dry, heat or provide some other form of heat-treatment for the product 1 in question, which plant is so arranged as to extend along the intended direction of travel 3 of the continuous strip. The plant 2 is constructed appropriately from a number of ramps 2A, 2B, 2C, 2D situated in a row one after the other, which ramps are in turn constructed from a number of modules 21A, 22A, 23A, which are able to support IR lamps or other heat-generating means. Air 4, or some other appropriate heat-treatment medium, is intended to be supplied to, amongst other things, the space 5 formed between the plant 2 and the continuous strip, etc. 1, for the purpose of providing the intended heat-treatment of the continuous strip 1, which, for example, is caused to travel in the direction 3 from a paper manufacturing machine 6 to a storage roll 7.

In accordance with the present invention an exhaust arrangement 8, 9 of a special kind is situated next to the plant 2 for the purpose of, amongst other things, solving the problems mentioned above. Exhaust arrangements 8 of a first kind are appropriately arranged between two plant ramps 2A, 2B, etc., positioned in a row across the continuous strip 1, whilst exhaust arrangements 9 of a second kind are arranged at the outlet 10 and/or the inlet 11 of the plant for the continuous strip 1.

The exhaust 12; 13 in question, which is principally connected to an exhaust channel 14; 15 . . . , inside which negative pressure Pu is present, permits process air, etc., 4 to pass over one surface 1A of the continuous strip in question in order, for example, to be led away for the subsequent recovery of the heat from the exhaust air, which will usually contain moisture.

In accordance with the invention said exhaust 12, 13 is so arranged as to be in communication with an inlet 16, 17, at which the pressure Po, which exists in the surrounding environment, is so arranged as to be effective The expression surrounding environment shall be understood in this case to denote the air space surrounding the plant, for example in the premises in which it is intended to operate, or air taken from a special chamber inside which essentially atmospheric pressure exists.

The air 4 flowing through air outlet holes 18 in the ramps 2A, 2B, 2C, 2D is so arranged as to be supplied, and is so arranged as to be caused to flow essentially parallel along said continuous strip 1 of product A suitable rate of flow may be between 5 and 100 m/s. The continuous strip 1 will then be acted upon by a force which attempts to push the continuous strip 1 in the direction of each module. This force is counteracted, however, by the static pressure generated by the air 4 as it flows out. Stabilization of the continuous strip 1 at an optimum distance from the modules is achieved in this way, which means that the force exerted by the pressure acting on the continuous strip 1 is reduced, which is beneficial in view of the poor strength characteristics exhibited by the continuous strip when wet, and that the transfer of heat between the air and the continuous strip 1 increases, which ensures the efficient removal of the water vapour driven off from the continuous strip 1 by evaporation due to the effect of the heated air flow 4.

The exhaust 12, 13 comprises more specifically an opening 19, 20 communicating with the surrounding environment, through which opening the pressure system inside the heat-treatment plant 2 can be punctuated by air, etc. 21, introduced from the surrounding atmosphere or from a chamber of the aforementioned kind.

In the case of an "edge exhaust arrangement" 9, the inlet opening 20 in question is situated on the inlet side 10 and/or outlet side 11 of the plant for the product 1 in the form of a continuous strip, whereas in the case of a "centre exhaust arrangement" 8, the inlet opening 19 can be connected to the surrounding environment via a channel 22 or some other suitable passageway at a certain distance from said continuous strip 1 between heat-treatment ramps 2A, 2B, etc., arranged next to one another in a row.

The exhaust 12 may consist of, on the one hand, an opening 23 leading to the area 5 along said surface 1A of the continuous strip and, on the other hand, an opening 19 communicating with the surrounding environment.

The exhaust 13 may also simply consist of an inlet opening 20 communicating directly with the surrounding environment, in which case a baffle 24, the purpose of which is to restrict the supply of air 21 from the surrounding environment to the exhaust 13, may be arranged at the opening 20. Said air diverter baffle 24 is so arranged as to form a column together with the surface 1A and to extend outwards from the plant in a transverse sense along the intended path of the continuous strip.

Arranged in the vicinity of said exhaust 12, 13 is a throttle 25, 26, which is intended to reduce the effective passageway 5A, 5B for the exhaust air in the direction of the outlet end.

Negative pressure Pu exists inside the exhaust air channel 27 of each ramp 2A, 2B, and atmospheric pressure Po exists in the surrounding environment, whilst positive pressure Pö exists inside the space 5 between the ramps 2A, 2B and the continuous strip 1. As the distance X between the plant 2 and the continuous strip 1 is increased in the vicinity of the column 5A, 5B, negative pressure is created which causes the continuous strip 1 to move in a direction towards the exhaust 12, 13 of the plant. As the distance X reduces, the pressure inside said column 5A, 5B is increased, partly by the air 4 which flows along the continuous strip 1 and the plant 2, and partly because the quantity of air present in the column 5A in the vicinity of the opening 23 is reduced. This means that the continuous strip 1 is not sucked fast against the plant 2, but is instead stabilized at a distance which is situated close to the pressure Po which is present on the reverse side 1B of the continuous strip. This distance X usually lies between 0.1 and 5 cm, depending on the stresses in the continuous strip.

As the quantity of air exhausted by suction through the opening 23 reduces, however, air 21 which essentially exhibits atmospheric pressure Po is taken in.

In the event of it not being possible for air 21 to be taken in this way via the opening 19, or by some similar route, the continuous strip 1 would be sucked fast against the opening 23 due to the negative pressure Pu which exists there. A self-balancing effect in the suction of the air 4, 21 is achieved thanks to the present invention, in addition to which the pressure, and thus also the quantity of air in the exhaust channel 27, can be varied quite considerably without the risk of the distance of the continuous strip from the plant 2 being caused to change significantly, or of it being sucked fast against the plant. No risk is associated, therefore, with causing a greater quantity of air to be evacuated via the channel 27, than the quantity of air sucked out via the opening 23. What is achieved in this way is a design which does not load the surrounding environment with hot, moist, or otherwise undesirable air which leaks out.

It is of considerable importance to the inlet and outlet ends 10, 11 of the construction to be able to utlilize all the supply air 4, for which reason the exhaust 13, as already mentioned, communicates with the surrounding atmosphere in the manner illustrated and described here. An alternative solution has been selected in this case, in which there is no exhaust hole which opens directly onto the continuous strip 1, and in which the process air 4 is instead able to pass by in the space 5B towards the surrounding atmosphere 28. In this way there is no risk at all of the continuous strip 1 being sucked fast to those sheet metal parts, etc. 29, of the plant which face towards the continuous strip, with the associated risk of damage to the continuous strip 1, not even when exhaust air 30 is sucked out in very large quantities. The process air 4 is instead effectively trapped by the baffle 24 outside the plant 2, which baffle also restricts to a minimum the quantity of air 21 taken from the surrounding environment. As a general rule the quantity of air 21 taken from outside is less than approximately 5% of the total quantity of air 30 sucked out. In those cases in which the process air is caused to flow out and to act essentially parallel with the continuous strip 1, as described above, and in so doing to act upon the continuous strip 1 with the so-called coanda effect, in a previously disclosed manner, so that the continuous strip 1 is acted upon by a sucking force, the throttle 25, 26 will bring about a pressure surge in the direction of flow of the air, which will reduce the suction force and will produce a more stable continuous strip 1 with more uniform pressure distribution.

In accordance with the present invention the purpose of the intended arrangement is to cause the air to apply a negative pressure to the continuous strip immediately after the air supply openings and the hollow part, as illustrated in FIGS. 8–10, so that the familiar coanda effect is produced on the continuous strip, and the strip is pulled down towards the drier, etc. The positive pressure which is produced at the outlet can be counteracted by connecting the outlet to another air opening at which atmospheric pressure exists, thereby permitting air to be sucked from the continuous strip in an unlimited quantity, without the risk of the continuous strip being sucked fast, and without being required to carry out precise adjustments to the quantity of and the distance from the air in various parts of the plant.

Thanks to the invention the adjustment of the ratio of the supply air to the exhaust air is simplified (is made less sensitive), at the same time as which a self-balancing effect is achieved. The adjustment of the quantity of exhaust air becomes non-critical. The continuous strip can be kept close to the drier at a constant distance from it.

The most important characteristic feature of the invention is the fact that the exhaust columns, both inside the drier and at the outlet end and the inlet end, are connected both to an exhaust channel with negative pressure and to the atmospheric pressure.

This design also solves the following problems:

The pressure system inside the drier is "punctuated" through the connection of a channel to the surrounding environment or to a chamber broadly speaking at atmospheric pressure. Only insignificant variations may occur in the surrounding environment or inside the chamber. An essentially more uniform pressure distribution is achieved in this way, and with it more uniform heat transmission and stability of the continuous strip. A self-balancing function is similarly achieved. Any variation in the quantity of exhaust air, in the quantity of supply air, and in the stretching of the continuous strip will have only a marginal influence on the stability of the continuous strip. In addition to being connected to the surrounding environment, the exhaust column is also connected to an exhaust channel at negative pressure, which causes the air to flow out via the channel.

The invention is not restricted to the illustrative embodiment described above and illustrated in the drawings, but may be modified within the scope of the Patent Claims without departing from the idea of invention.

I claim:

1. Arrangement for an exhaust in a heat-treatment plant having a number of heat-treatment ramps arranged next to one another in rows for heat-treating a product in the form of a continuous strip, including means for affecting the continuous strip with a heat-treatment medium which is supplied to the continuous strip to flow essentially parallel along the strip in a common direction, and an exhaust which allows the heat-treatment medium to pass outwards from one surface of the continuous strip, characterized in that said exhaust is situated at the ends of the ramp, respectively, along the flow direction of the heat-treatment medium, said exhaust being connected to an exhaust channel in which negative pressure is present, said exhaust, via an opening, communicates with an area along the surface of the continuous strip, and said exhaust includes an air opening communicating with a space where essentially atmospheric pressure is present, and via which the pressure system inside the heat-treatment plant can be affected by air introduced from the surrounding environment.

2. Arrangement in accordance with claim 1 characterized in that an exhaust opening communicates with the surrounding environment.

3. Arrangement in accordance with claim 2, characterized in that an air diverter baffle device, is arranged at the air opening for the purpose of restricting the supply of air from the surrounding environment to the exhaust.

4. Arrangement in accordance with claim 3, characterized in that the air diverter baffle forms a column together with said surface of the continuous strip and extends outwards from the plant along the intended path of the continuous strip.

5. Arrangement in accordance with claim 1, characterized in that the exhaust includes an opening leading to the area along said surface of the continuous strip and an opening communicating with the surrounding environment.

6. Arrangement in accordance with claim 5, characterized in that the opening communication with the surrounding environment is connected to the surrounding environment at a certain distance from said continuous strip via a passageway.

7. Arrangement in accordance with claim 6, characterized in that the passageway extends between heat-treatment ramps arranged next to one another in rows.

8. Arrangement in accordance with claim 1, characterized in that the effective air passageway for the exhaust air reduces in the region of the exhaust of the end of the heat-treatment ramp, due to the presence of a throttle.

9. Arrangement in accordance with claim 2, characterized in that the exhaust includes an opening leading to the area along said surface of the continuous strip and an opening communicating with the surrounding environment.

10. Arrangement in accordance with claim 3, characterized in that the exhaust includes an opening leading to the area along said surface of the continuous strip and an opening communicating with the surrounding environment.

11. Arrangement in accordance with claim 4, characterized in that the exhaust includes an opening leading to the area along said surface of the continuous strip and an opening communicating with the surrounding environment.

12. Arrangement in accordance with claim 2, characterized in that the effective air passageway for the exhaust air reduces in the region of the exhaust of the end of the heat-treatment ramp, due to the presence of a throttle.

13. Arrangement in accordance with claim 3, characterized in that the effective air passageway for the exhaust air reduces in the region of the exhaust of the end of the heat-treatment ramp, due to the presence of a throttle.

14. Arrangement in accordance with claim 4, characterized in that the effective air passageway for the exhaust air reduces in the region of the exhaust of the end of the heat-treatment ramp, due to the presence of a throttle.

15. Arrangement in accordance with claim 5, characterized in that the effective air passageway for the exhaust air reduces in the region of the exhaust of the end of the heat-treatment ramp, due to the presence of a throttle.

16. Arrangement in accordance with claim 6, characterized in that the effective air passageway for the exhaust air reduces in the region of the exhaust of the end of the heat-treatment ramp, due to the presence of a throttle.

17. Arrangement in accordance with claim 7, characterized in that the effective air passageway for the exhaust air reduces in the region of the exhaust of the end of the heat-treatment ramp, due to the presence of a throttle.

* * * * *